United States Patent [19]

Mahaffey

[11] Patent Number: 4,503,648

[45] Date of Patent: Mar. 12, 1985

[54] LIGHTWEIGHT COMPOSITE BUILDING MODULE

[76] Inventor: Donald H. Mahaffey, 805 Sycamore St., Decatur, Ga. 30030

[21] Appl. No.: 448,368

[22] Filed: Dec. 9, 1982

[51] Int. Cl.[3] ..... E04C 3/10

[52] U.S. Cl. ..... 52/227; 52/233; 52/309.11

[58] Field of Search ..... 52/233, 309.11, DIG. 8, 52/731, 425, 426, 562, 564, 309.4, 309.8, 309.17, 284, 285, 227

[56] References Cited

U.S. PATENT DOCUMENTS

| | | | |
|---|---|---|---|
| 1,752,103 | 3/1930 | Morrison | 52/731 |
| 2,598,867 | 6/1952 | Weitz | 52/785 |
| 2,669,861 | 2/1954 | Clutter | 52/444 |
| 2,880,470 | 4/1959 | Pickersgill | 52/564 |
| 3,166,802 | 1/1965 | Schmidgall | 52/286 |
| 3,273,299 | 9/1966 | Hartung, Jr. | 52/731 |
| 3,343,328 | 9/1967 | Rolle | 52/285 |
| 3,462,897 | 8/1969 | Weinrott | 52/309.11 |
| 3,552,079 | 1/1971 | Mortensen | 52/309.8 |
| 3,742,665 | 7/1973 | Henry et al. | 52/233 |
| 3,979,862 | 9/1976 | Hamilton et al. | 52/233 |
| 4,246,733 | 1/1981 | Haber | 52/309.11 |
| 4,272,073 | 6/1981 | Grosser et al. | 52/731 |
| 4,304,080 | 12/1981 | Freeman | 52/309.11 |
| 4,305,238 | 12/1981 | Harward | 52/309.4 |
| 4,344,263 | 8/1982 | Farmont | 52/233 |

FOREIGN PATENT DOCUMENTS

| | | | |
|---|---|---|---|
| 132346 | 4/1949 | Australia | 52/464 |
| 0532141 | 8/1931 | Fed. Rep. of Germany | 52/584 |
| 1062502 | 4/1954 | France | 52/227 |

*Primary Examiner*—John E. Murtagh
*Assistant Examiner*—Andrew Joseph Rudy
*Attorney, Agent, or Firm*—Dority & Manning

[57] ABSTRACT

A lightweight composite building module capable of being readily attached to other correspondingly shaped modules for providing a wall of a building. The module includes a pair of spaced elongated wooden side boards joined by a wooden top board. The side boards have right angle cutouts removed from the inside corners thereof producing upper and lower horizontally extending ledges. Polyurethane foam is provided in the cavity defined by the side boards and top boards with said foam extending below the lower horizontally extending ledges. Elongated wooden bolts extend between the top boards of adjacent stacked modules drawing said modules tightly together under compression so that the top board of the next lower module compresses the foam extending below the lower horizontally extending ledges of the module carried directly therebelow producing a rigid sealed joint therebetween .

6 Claims, 5 Drawing Figures

LIGHTWEIGHT COMPOSITE BUILDING MODULE

BACKGROUND OF THE INVENTION

Heretofore, logs have been utilized in building houses and other structures, and in the days of the pioneers, such were used because of the ready availability of the large logs and the inability to readily saw the logs into planks. These log buildings provided adequate insulation due to the thickness of the logs and at the time were practical due to the abundance of wood for heating the building. However, in recent times, it has become less practical to build structures primarily from logs because they provide less comfort and insulation value in an era of high energy costs.

One reason is that large logs are not readily available and, when available, they are impractical from an expense standpoint to be used in building houses or other buildings. Smaller logs are not satisfactory in that they do not provide adequate insulation.

In attempts to combine the insulation characteristics of synthetic materials such as urethane foams with the aesthetic and strength characteristics of logs, laminated structures have been suggested. One such laminated structure is disclosed in U.S. Pat. No. 3,552,079. Another structure provided for simulating logs is disclosed in U.S. Pat. No. 4,305,238. The simulated log disclosed therein includes at least two semi-circular imitation log siding sections which are joined together. Other insulated building structures using foam are disclosed in U.S. Pat. Nos. 3,992,838, 3,978,255, 4,069,629, and 4,147,000.

SUMMARY OF THE INVENTION

In an attempt to produce a simulated log which has good thermal insulation characteristics and can be readily assembled to produce a log cabin or building, the desirable characteristics of both urethane foam and wood have been utilized to produce a lightweight composite building module. The module is capable of being readily attached to other correspondingly-shaped modules for producing a wall for a lightweight composite building structure. It is to be understood that when the term "wall" is utilized in this application, it can be a floor or ceiling.

The module includes a pair of spaced elongated wooden side boards joined by wooden top and bottom boards. The side boards have right angle cutouts removed from the inside corners thereof producing upper and lower horizontally extending ledges. Urethane foam is inserted within the cavity defined by the side boards and top and bottom boards and expands to the shape of the cavity. When there is no bottom board utilized, then a removable jig is positioned where the bottom board would be placed so as to allow the foam to expand approximately ⅛" below the lower ledges in the side walls. Fastening means in the form of elongated wooden bolts extend through the top boards of one module and screw into the top board of a moldule positioned directly therebelow when the modules are stacked one on top of each other. The top board has alternate conical shaped holes and threaded holes so as to accommodate the wooden bolts. When the bolt is drawn down tightly, it causes the modules to be drawn tightly together under compression with the ledges in the side walls absorbing the compressive force. When the bottom board is eliminated, as the modules are drawn tightly together, the top board of the next lower module compresses the foam in the bottom of the module back to a point where the top board engages the ledges provided in the side boards.

Accordingly, it is an important object of the present invention to provide a lightweight composite building module which can be readily assembled to simultaneously produce the inside and outside walls of a building.

Another important object of the present invention is to provide a lightweight composite building module which can be readily assembled with other modules in a composite wall of substantial strength with the joints between the modules being substantially sealed.

Still another important object of the present invention is to provide a lightweight relatively inexpensive building module having a high insulation value, and Another important object of the invention is to produce a building module from a plurality of elongated members that are placed in a jig, and polyurethane foam is inserted therebetween and allowed to expand filling the space between the elongated members and adhering to the sides thereof to hold the unit together.

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein:

DESCRIPTION OF A PREFERRED EMBODIMENT

Figure 1:
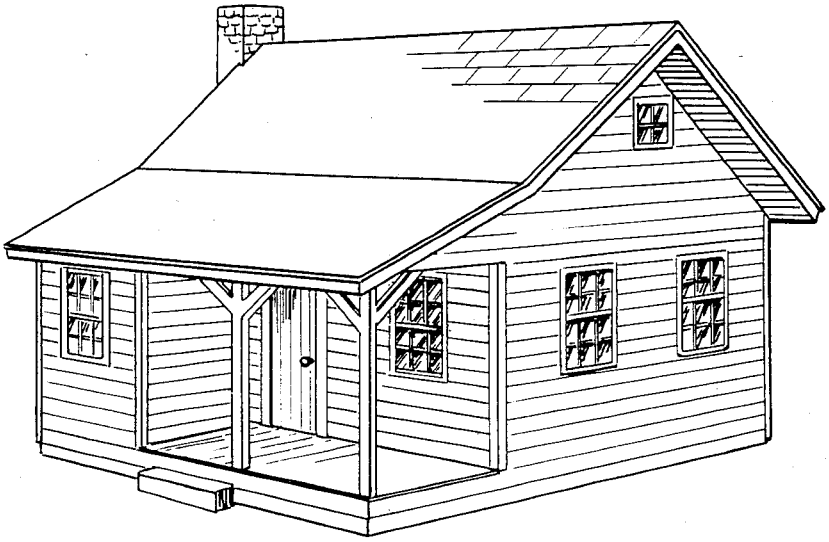
FIG. 1 is a perspective view illustrating a cabin constructed utilizing the composite building modules.

Referring in more detail to FIG. 1, there is illustrated a cabin that could be readily constructed from the composite building modules with the exterior wall of the cabin being one side of the module and the interior wall of the cabin being the other side of the module. It is to be understood that while the predominant use of the modules in making walls would be for side supporting walls, modules can be assembled on their sides to produce ceilings and in some instances, roofs for buildings. In all situations, they produce a highly efficient insulating building structure.

Figure 2:
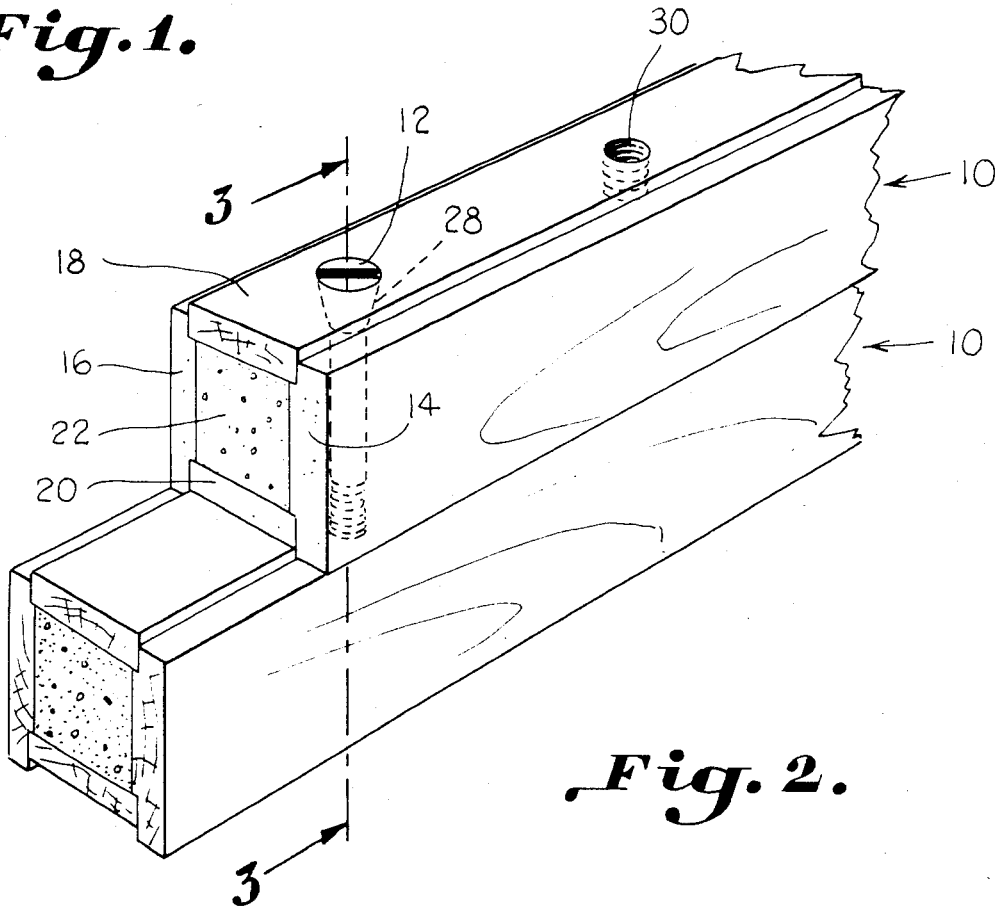
FIG. 2 is an enlarged perspective view illustrating a building module constructed in accordance with the present invention stacked on top of another building module.
Figure 3:
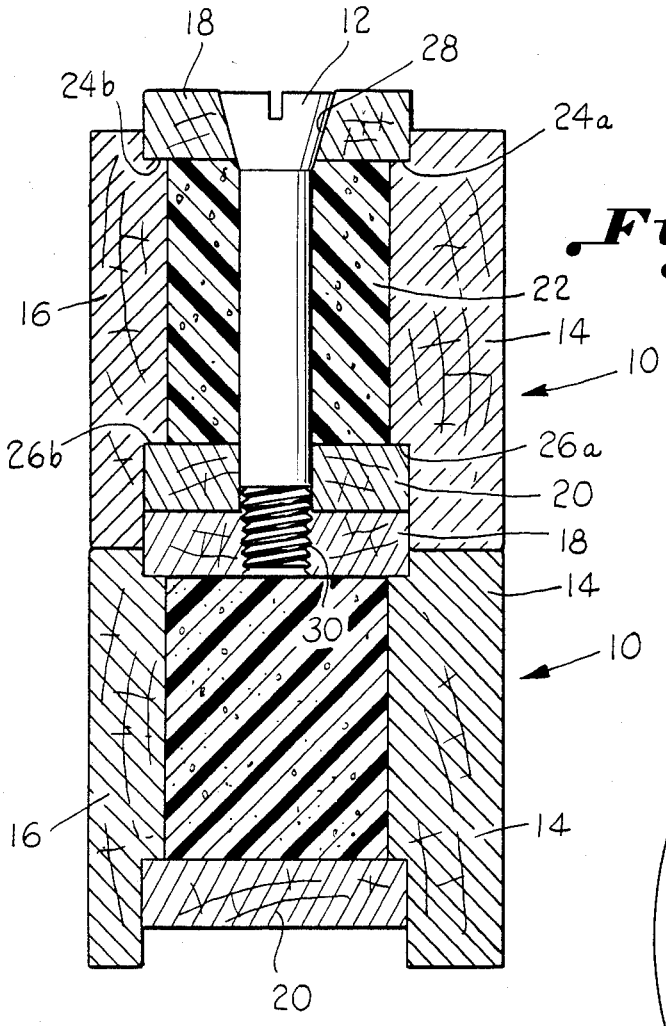
FIG. 3 is a sectional view taken along line 3—3 of FIG. 2.

Referring to FIGS. 2 and 3 of the drawing, there is illustrated a pair of modules generally designated by the reference character 10 that are stacked upon each other and secured thereto by elongated wooden bolts 12. Each of the modules includes a pair of spaced elongated wooden boards 14 and 16 which are joined by a top board 18 and a bottom board 20 defining a cavity therebetween. Polyurethane foam 22 is inserted in the cavity and allowed to expand to completely fill the entire cavity formed by the wooden boards 14 through 20. Each of the side boards 14 and 16 have right angle cutouts removed from the inside corners thereof producing upper and lower horizontally extending ledges 24*a* and 24*b* and 26*a* and 26*b*, respectively. The width of the top board 18 and bottom board 20 are such that they fit within opposed cutouts provided on the side walls 14 and 16 and rest on respective ledges 24*a* and 24*b* or 26*a* and 26*b*. Spaced along the length of the top boards 18 are alternate conical shaped holes 28 and threaded holes 30. Directly below each of the holes 28 and 30 in the bottom board 20 are openings through which the bolt 12 can extend.

When assembling the building modules, they are placed one on top of the other in a tongue-in-groove fashion and the wooden bolt 12, which has a conical shaped head, is inserted through the hole 28 provided in the top board 18 and screwed tightly into a threaded hole 30 provided in the top board of the module position therebelow. As a result, the modules are drawn tightly together under compression with the ledges in the side walls absorbing the compressive force producing a strong and sturdy wall with an overlapping joint. It is noted that no adhesive is required and there are no exposed nails. Normally, in selecting the type of wood used for the boards, it is kept in mind that the side board 14 can be used for the exterior of the wall with the side board 16 being ready for use as an interior wall. In one particular application, pine was utilized, however, it is to be understood that any suitable wood or other material such as a composite board could be used in forming the module.

Figure 4:
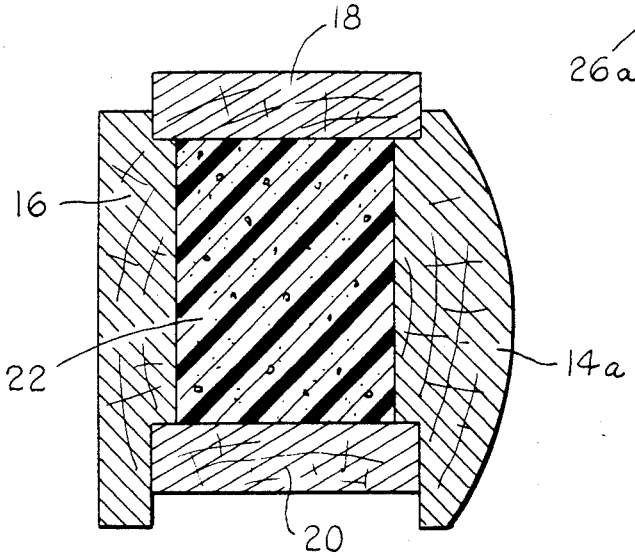
FIG. 4 is a sectional view of a modified form of the invention.

In FIG. 4, there is illustrated a modified form of the invention wherein the outer wall 14*a* has a convex surface so as to simulate a portion of a log so that when the modules are stacked one on top of the other, they will form a wall similar to that of a log cabin.

Figure 5:
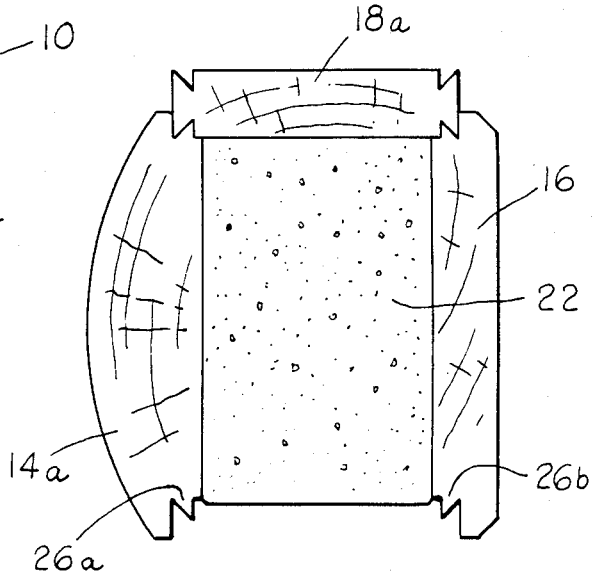
FIG. 5 is an end view of still another modified form of the invention.

In FIG. 5, there is a dovetail connection between the side walls 16 and 14*a* and the top wall 18*a*. It is noted that the foam 22 is allowed to extend below the ledges 26*a* and 26*b*. As a result, when the modules are secured together with the bolts such as shown in FIG. 3, the portion of the foam 22 extending below the ledges 26*a* and 26*b* is compressed producing a rigid sealed joint between the modules.

Normally, when constructing the modules, jigs are used for holding the side boards and top and bottom boards in place while the foam is inserted in the cavity defined therebetween. This is to prevent movement of the boards as the foam expands to fill the cavity. As the polyurethane material expands, it adheres to the inside walls of the boards and, upon removing from the jig, is a sturdy rigid module.

What is claimed is:

1. A lightweight composite building structure comprising:

a plurality of correspondingly-shaped modules stacked one above another, producing a wall for a building, each of said modules including, (i) a pair of spaced elongated wooden side walls having inner and outer corners joined by a wooden top and a bottom wall defining an elongated cavity;

(ii) urethane foam filling said elongated cavity;

(iii) said inner corners of said pair of spaced elongated side walls having recesses provided thereon forming ledges upon which said top and bottom walls rest;

(iv) said wooden top being nested between the recesses of said side walls of another module stacked thereon; and a fastening device extending between said stacked modules drawing said modules tightly together under compression with said ledges in said side walls absorbing said compressive force producing a lightweight wall structure.

2. The building module as set forth in claim 1 further comprising:

a first opening provided in said wooden top for reciving a head of an elongated fastening device, and another opening provided in said wooden top for receiving a bottom portion of an elongated fastening device.

3. The lightweight composite building module as set forth in claim 2 further comprising:

said first opening in said wooden top being conically shaped with the larger diameter end facing the top of said top wall;

threads carried in said another opening, and said fastening means being a bolt having a conical head portion and threads on a lower shank portion so that by rotating said bolt, said modules can be drawn tightly together.

4. The lightweight composite building module as set forth in claim 1 further comprising:

the outer surface of one of said side walls being convex simulating the curvature of a log, and the outer surface of said other side wall being planar so as to produce a planar interior wall of a building when said modules are stacked on each other.

5. A lightweight composite building structure comprising:

a plurality of correspondingly-shaped modules stacked one above another producing a wall for a building, each of said modules including, a pair of spaced elongated wooden side boards having inner and outer corners, joined by a wooden top board;

said side boards having cutouts removed from the inside corners thereof producing upper and lower horizontally receiving ledges;

polyurethane foam carried in a cavity defined by said side boards and said top board with said foam extending below said lower horizontally extending ledges;

fastening means extending between said top boards of adjacent stacked modules drawing said modules tightly under compression so that said top board of said next lower module compressed said foam extending below said lower horizontally extending ledges of the module carried directly thereabove producing a rigid sealed joint therebetween.

6. The composite building module as set forth in claim 5 further comprising:

said cutouts being dovetail cutouts which cause a positive sealed joint when two modules are stacked one upon the other.

* * * * *